United States Patent [19]

Tscherwitschke et al.

[11] 4,162,951

[45] Jul. 31, 1979

[54] ELECTROPLATING APPARATUS WITH SELECTIVELY INTERCHANGEABLE, CONNECTABLE DRUMS

[76] Inventors: Richard Tscherwitschke, Dieselstrasse 21, Leinfelden-Echterdingen, Fed. Rep. of Germany, 7022; Hans Henig, Albrecht-Achilles-Str. 48, Nüremberg, Fed. Rep. of Germany, 8500

[21] Appl. No.: 955,165

[22] Filed: Oct. 27, 1978

[30] Foreign Application Priority Data

Oct. 31, 1977 [DE] Fed. Rep. of Germany ..... 2748763

[51] Int. Cl.[2] ..... C25C 7/00

[52] U.S. Cl. ..... 204/213; 204/214

[58] Field of Search ..... 204/213, 212, 214

[56] References Cited

U.S. PATENT DOCUMENTS

| | | | |
|---|---|---|---|
| 2,500,861 | 3/1950 | Phillips, Jr. | 204/213 X |
| 2,860,099 | 11/1958 | Barton | 204/213 |
| 2,865,831 | 12/1958 | Ransohoff | 204/213 |
| 3,038,851 | 6/1962 | Jackson | 204/213 |
| 3,270,855 | 9/1966 | Harper et al. | 204/213 X |
| 4,098,665 | 7/1978 | Frechin | 204/213 |

*Primary Examiner*—Arthur C. Prescott

*Attorney, Agent, or Firm*—Holman & Stern

[57] ABSTRACT

Disclosed is a single electroplating apparatus capable of utilizing varying numbers and sizes of drums for electroplating batches of small elements. All drums have a common end portion which connects with the apparatus to orient the drum with an essentially horizontal axis of rotation permitting interchangeability of drums. The drums in a preferred embodiment are diecast from a synthetic plastic and have mesh sides to facilitate electrolyte circulation and current flow.

13 Claims, 11 Drawing Figures

FIG.2a
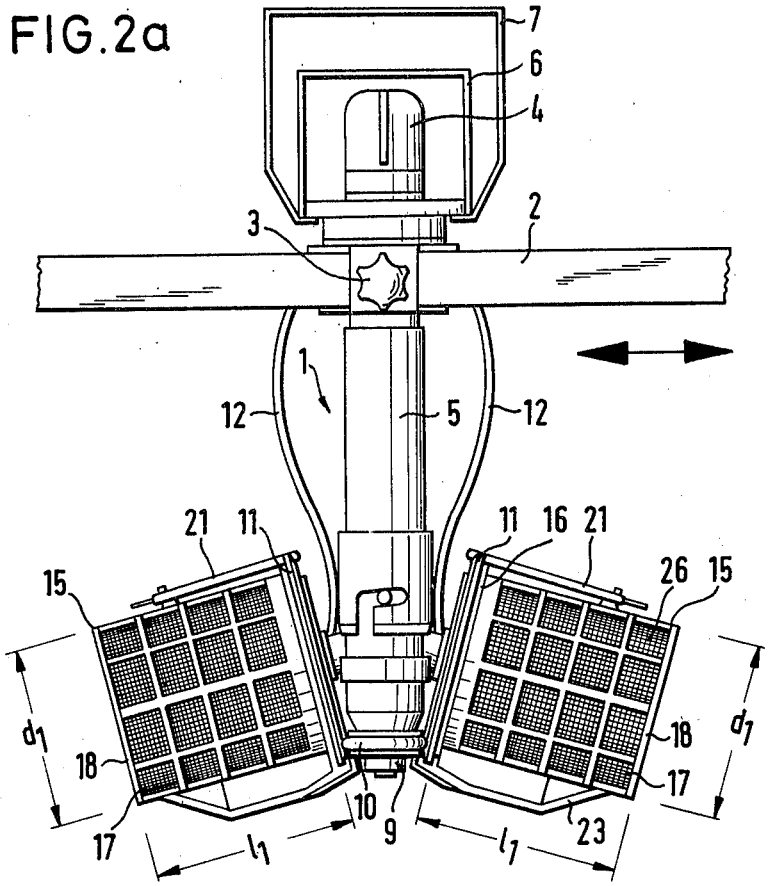
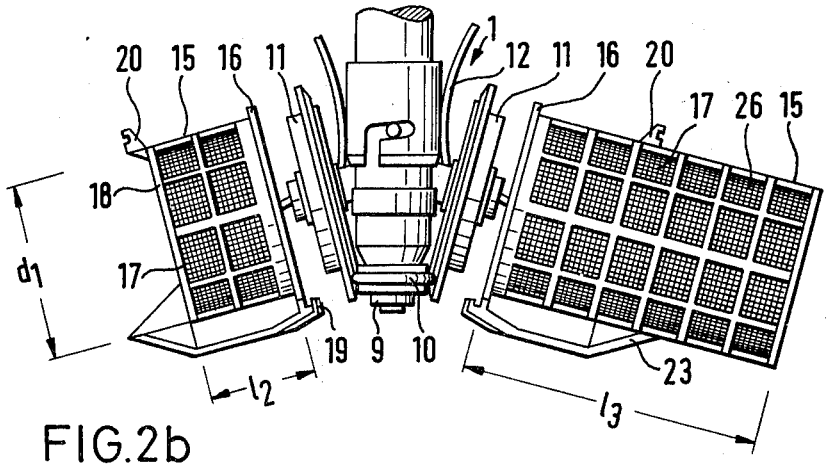
FIG.2b

FIG. 4b
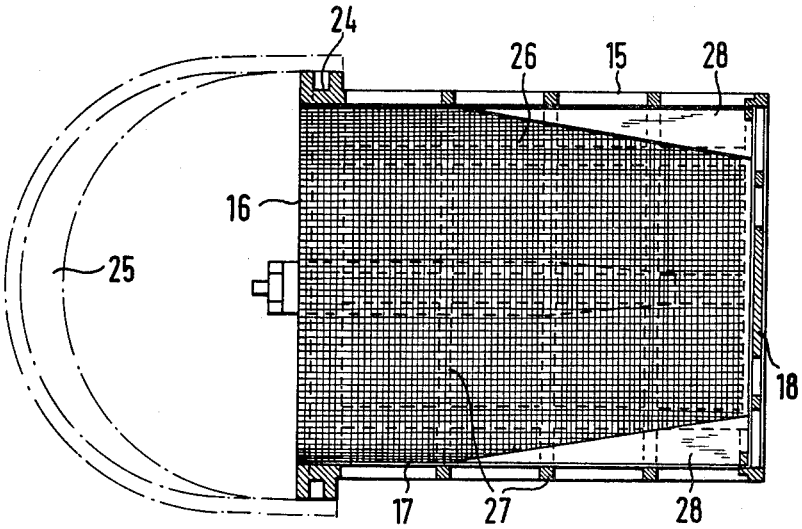
FIG. 5
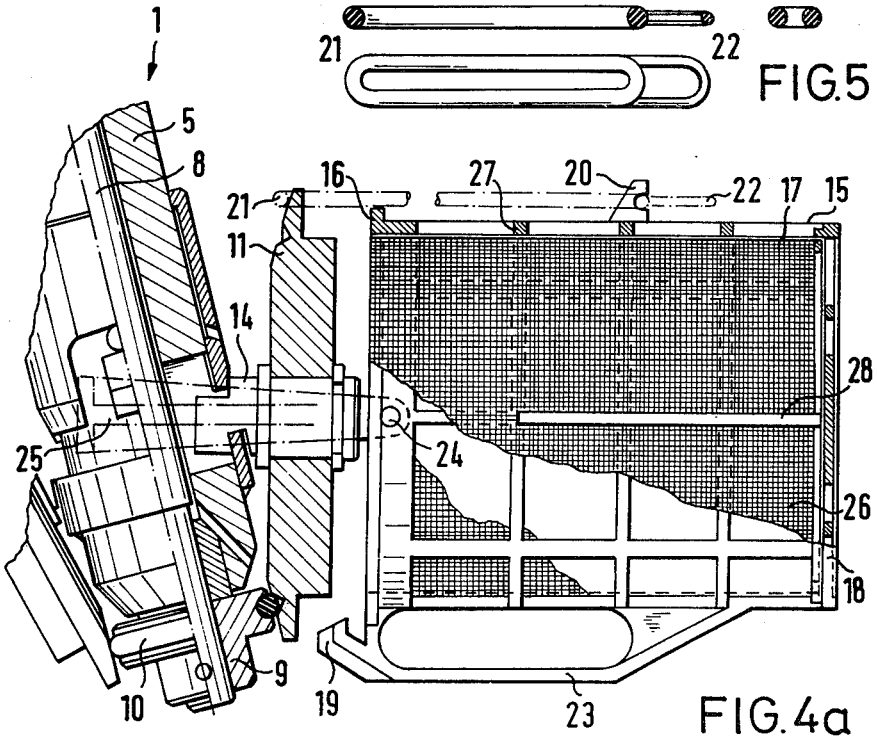
FIG. 4a

ELECTROPLATING APPARATUS WITH SELECTIVELY INTERCHANGEABLE, CONNECTABLE DRUMS

BACKGROUND OF THE INVENTION

The instant invention concerns an apparatus for the electroplating of chargeable mass elements in a cylindrical drum which rotates about its longitudinal axis, wherein said drum consists of its perforated, cylindrical cover, and its two end portions which are in vertical position to the rotational axis; whereby one of the end portions is irremovably fastened on the cylindrical drum cover serving as a cylinder base, and the other end portion is removably arranged as a cylinder cover for loading and unloading of the drum with the mass elements.

Such devices are generally utilized for electroplating relatively small amounts of very small mass elements, which exist mainly in the industries of electronics, watchmaking or jewelry-making. The mass elements to be treated appear mostly in small charge sizes, however, they are characterized by a very large variety of types and, due to often being very small of dimension, they require the drum to have fine perforations. The parts, for example transistors, may be of extreme sensitivity to mechanical damage. The various types of mass elements having varying charge sizes require drums with various capacities, as well as various rotational speeds (rate of revolutions), as well as various systems of cathodic contacting and last but not least varying perforations of the drum cylinder.

The prior art devices consist in general of a cylindrical drum member, which rotates between two supporting arms whereby said arms reach vertically into the electrolyte. The two support arms are provided with bearings to hold the drum. The bearing arms themselves are fastened at their upper ends to a frame, which rests on the cathode- or anode-rods of the shell which contains the electrolyte. The frame carries the electric driving motor, which is required for the rotational movements of the drum body. The rotational momentum is transmitted on the motor by means of a set of toothed wheels from the motor to the drum (driving pinion on the motor, interim wheel on one of the support arms and toothed wheel on a front side of the drum). The power which is required for the electroplating is received by the cathode rod via the frame and (generally by means of two cables which are placed through the two hollow spaces of the drum into the inside of the drum) is guided to the mass of elements which is to be plated.

The practice of electroplating very small mass elements forces the user to equip himself with a large number of various drum devices which characterize themselves predominantly by varying capacities of the individual drum cylinders, varying perforations of the cylinder covers, and varying cathodic contact systems in the drum. The required multitude of the varying drum apparati is expensive in procuring, maintaining, and is disadvantageous with regard to their practical handling (for performing the individual method-technical process steps in the series of the required solutions of treatment).

In prior art, devices are known which enable the exchanging of the drum cylinders fixed between the two support arms. The drum apparatus is thus divided into an apparatus (consisting substantially of the two support arms, the frame with the motor, the toothed wheel drive as well as the cathodic contact msystem) on one hand and the drum cylinder on the other hand. The apparatus fulfills exclusively the functions of holding and rotating the drum in its operational position, as well as conducting the electroplating current into the inside of the drum.

One of the prior art devices of the above-described type contains the control slits in the two support arms, through which are inserted the two pins of the drum cylinder in the operational position. One each bearing clip being pivotable about a clamping screw, arresting the associated bearing pin in its operational position. When one clamping screw is loosened, then the bearing clip can be tilted away around the clamping screw as point of rotational means, and the drum cylinder can be removed from the apparatus.

A further apparatus of this type proposes that one of the support arms is laterally folded away (by means of a hinge joint) and the drum cylinder can be inserted into or removed from the apparatus in an axial direction.

The above-discussed prior art devices, even though permitting the insertion of drums having varying perforations, under utilization of a single driving- and holding-aggregate, they do not however provide for the exchangeability of drums of varying capacities, which with a distance is the primary method-technical necessity. The prior art drum-apparati also do not consider the very large multiplicity of the mass elements which appear mostly in small character-sizes and must be plated separately according to their types.

There are furthermore devices known in the prior art which are clamped to the edge of the shell which contains the electrolyte. They are characterized by means of a very long shaft which is directed on a slant from the shell-edge (in general under an angle of about 45° to the vertical) towards the bottom of the shell, below the lower end of which is fixedly attached a basket-like container for receiving the elements to be plated.

The axle of the shaft and the axle of the basket run coaxially and the shaft and basket are in synchronized rotation. The steep angle pitch of the basket has a result that only a small part of the capacity can be filled by the elements. The disadvantageous angle-pitch prevents an effective mixing of the elements, and consequently results in an uneven plating on the mass elements. In order to improve the uniformity of the electroplating, the number of elements in a batch must accordingly be reduced.

SUMMARY OF THE INVENTION

It is the scope of the present invention to construct an apparatus in a fashion so that the size of a batch of those elements which change in the practice as well as varying types of small to very small mass elements, can be electroplated in a cost-effective, economical manner, and namely at a minimum initial expenditure pertaining to an apparatus.

This problem is inventively solved in that during electroplating the drum is connected only at one of its two front sides to the apparatus preferably vertically extending into the electrolyte. To facilitate loading or unloading of the elements to be plated, the entire drum or at least the cylindrical drum cover with the cylinder bottom fixedly attached thereto is removed from the apparatus by means of withdrawal from the coupling.

According to the inventive solution, the drum apparatus represents a function with a number of advantages, such as: (a) the holding of the drum member in its predetermined operational position in the electrolyte, and (b) its rotating in the operational position, with (c) the lead of the electroplating conductor in the inner area of the drum as well as the cathodic charging of the mass elements located therein.

As the actual requirements of electroplating may vary, the apparatus facilitates the use of drums of varying volumes, as well as varying the size of the perforations of the drum cover depending on the mass elements.

Inventively, the functional sizes a, b, and c (as constants) apparatively collected in an apparatus which in and of itself is closed and, separated therefrom, the drum member is constructively shaped according to the variables d and e, independent of aggregates. It is thus possible when absolutely necessary to always select one drum having the most suitable volume and to connect same to the apparatus by means of a releasable coupling. The varying drums are thus selected according to the needs and are exchangeable in the inventive drum apparatus.

The user requires no longer a multitude of drum apparati in order to comply with the requirements of electroplating of small parts in the practice, but will only require a single apparatus as the basic instrument, and a set of various drums (of varying lengths and diameters as well as perforations) which can be selectively connected and exchanged on the apparatus.

It has furthermore been proven advantageous for the mixing of the charge to allow the rotational axis of the drum to deviate as little as possible from the horizontal. The deviation should not exceed an angle of 30°.

The individual drum members are connected to the apparatus by means of a coupling. The coupling consists of two sections, one on the apparatus and one on the front portion of the drum member. The coupling section on the apparatus forms the driving shaft and is provided with a cavity for holding the coupling section which is located on the drum member, in order to retain the drum member thereby in the predetermined operational position, and to transmit the rotational momentum to the same. The coupling section of the apapratus rotates about a fixed hollow axle. The cable for the input of the electroplating current is located through the hollow axle and a central borehole in the coupling section of the drum into the inner space of the same.

If one moves the coupling inwards, then the drum member is solidly connected to the apparatus; if the coupling is moved outwards then the drum member is separated from the apparatus and can be removed from the same.

According to the instant invention, the coupling section on the drum member is the same size even though the drum size and shape may vary. This will guarantee that each drum, independent of its length $l_i$, its diameter $d_i$ or cross section, is connectable to the coupling section of the apparatus.

A preferred embodiment of the instant invention proposes the coupling section on the apparatus to be of a flat disk-shape, and having a diameter which is equal to the diameter of the drum cylinder. The coupling disk on the apparatus in this case forms the front side of the drum member and is being utilized as the lid of the same (namely for closing the axial drum opening through which the loading or unloading of the drum with the charge is being made). The disconnected drum consists thus only of a cylindrical drum cover and its rear portion, which, as a cylinder bottom, is irremovably fastened on the cover.

The coupling section on the drum in this case is an annular disk which is concentrically arranged outside of the drum cylinder, namely, on the open end of the same.

The apparatus stands preferably vertical in the electrolyte. It has been surprisingly found that it is possible to simultaneously connect two drums at both sides of the apparatus. The arrangement of oppositely placed drums represents an especially advantageous embodiment of the present invention and provides a line of exceedingly practical as well as cost-effective advantages which, in their effect, go substantially beyond the solution of the problems which characterize the state of the art.

If one designates the length of the drum with $l_i$, then, by means of the arrangement of two equal drums at both sides of the apparatus, its total length will double to $(l_1+l_1=)2\ l_1$ and thus will double also the full volume available for receiving the elements to be electroplated.

The drum apparatus in the inventive tandem-embodiment has a double electroplating performance.

It is furthermore possible, by arranging two drums on one apparatus, which in themselves are sealed by means of each separate lid, to plate simultaneously two different charges of varying types of mass elements, without mixing the varying types together.

The doubling of the batch sizes, or the simultaneous electroplating of two varying charges, means a 50% reduction of costs for the manual part of labor which is necessary for the moving of the respective charges through all of the required treatment solutions.

The 50% reduction of the labor costs means as well an almost 50% reduction of wages or a doubling of the speed of moving the amount of small particles to be galvanized.

It has furthermore been surprisingly noted that it is possible to arrange three drums analogeous in star-fashion around the apparatus, whereby the rotational axis of two each adjacent drums (in the basic cross-sectional view) form an angle of 120°. The increases in performance in view of the state of the art corresponds with the above-noted disclosures and increase proportionally.

It is further considered a point of the invention that, in so far as one structures the rotational momentum on the drums constructively sufficiently large, to simultaneously arrange four drums.

The drums according to the state of the art are in general provided with a perforated cover; the two end portions, however, are not perforated. The instant invention, however, proposes that at least each end portion which is not coupled to the apparatus is provided with perforations. The drum, for example in a practical embodiment of the inventive apparatus, has a length of 150 mm and a diameter also of 150 mm. The perforation of the end portion which is facing away from the apparatus has as a result that the entire penetration area on the peripheric wall of the drum, which is open for the electroplating current as well as for the electrolyte exchange (i.e., being perforated), increases from 7.1 $dm^2$ to 9.8 $dm^2$, namely, by about 26%. The electroplating performance which is depending proportionally on the height of the current increases proportionally. The uniformity and quality of the metal layer plated is improved simultaneously to a substantial degree.

As a further improvement, the instant invention proposes to determine the disk-shaped coupling portion to form the lid on the aggregate for loading or unloading of the drum with the charge, and to provide same also with perforations. The surface area of the cover, according to the above-mentioned practical embodiment, is 7.1 $dm^2$; if both end portions are perforated, then the penetration area, which is open for electroplating current and the electrolyte, increases along the entire periphery of the drum to 10.60 $dm^2$, i.e., by about 50%. The plating provided in such a drum proves to be a great improvement in view of the prior art devices.

In order to further increase the electroplating effect, the instant invention proposes to manufacture the cylindrical cover or the front portion of the drum not as commonly done out of perforated sheets of synthetic material, but to manufacture the covers of the drum preferably out of a fine-meshed texture (an extruded grill) consisting of a suitable synthetic material, such as, for example, polypropylene.

The substantial cost-effectiveness advantages of such a cover are obvious: very high densities of extremely small grill-openings ("perforations") represent almost open cover areas for the electroplating current and the liquid exchange.

The instant invention has shown that drum covers made out of a synthetic material with a grill-width of 0.53 mm, 0.36 mm and even 0.18 mm preferably for the plating of the smallest electronic structural elements (especially of transistors) are suitable. Such small and densely arranged openings in the drum cover cannot be manufactured with mechanical means (such as boring small holes into synthetic sheets).

The synthetic texture (extruded grill) is stretched onto a frame and, together with the same, forms the inventive drum, consisting of the cylindrical cover and the end portion permanently attached thereto. It is being required that the end portion which is fixed to the drum cover as well as that which is arranged on the apparatus and used as its lid, in so far as these should be perforated, may be covered with the same synthetic texture.

It has been previously proposed in the art to stretch the synthetic texture onto a rectangular frame, whereby the texture is glued to this frame, being clamped between the frame strips by means of buttseam welding or being fused (with hardenable resin), which is permitted to enter into the frame strips. The individual frames form individual sides of the prismatic drum cylinder. The covering of a drum in this manner has proven to be too costly and technically as being too difficult to find use in practice.

The instant invention proposes therefore to manufacture the drum or the drum frame not in a mechanical process but under the die-casting method. It is thereby proposed to manufacture the frame for the cover as well as the fixed end portion in one single process of the die-casting method, whereby the synthetic material for the cover is placed into the casting form. The drum, comprising the afore-mentioned structural elements, is consequently a single die-cast part without seams, namely a single homogeneous piece.

The texture is cast in the individual rods of the drum frame, or is cast (glued) to the same; the die mass thus covers the texture in the area of the frame rods and fastens the same in this manner. It will not be necessary to mention especially that the coupling portion on the drum (which is the annular, concentric disk arranged outside the drum cylinder at the open end of the same) has also been considered during the manufacture of the die-casting form, and this coupling portion represents a seamless component of the drum which is provided during the die-casting method.

Thermoplastic synthetic materials, and in specific cases polypropylenes, are preferred as die-casting masses for the frame of the drum member.

The proposal according to the instant invention, to manufacture the drum in the die-casting method, is of importance with regard to manufacturing-techniques. The manufacture of drums which is costly with regard to intensive wages, is replaced by a single working phase, which leads from the unformed raw material (from granulates of the die-casting mass) and semi-product (from a synthetic texture) to the completed one-piece object, namely, to the drum, including its coupling disk.

Regardless of the qualitative and quantitative increase of the electroplating performance due to the substantially higher electroplating flow and liquid exchange through the texture-wall, a further optimal important method component is: The very small thickness of the wall and the seamlessness of the drum member (due to the manufacture in the die-casting method) reduces the amount of electrolytes or other treating solutions to a minimum when the drum is withdrawn. The reduction is to be evaluated under two aspects: reduction of the loss on electrolyte, which especially in the electroplating in fine-metal bathes is of special economic importance, and furthermore, the tremendously lower amounts required for the neutralisation baths, as well as purification-installations for the waste waters.

It is known in the art that especially advanced threads of polymerisates (for example polypropylene) obtain specific resistances to tearing, which are in a size-range equal to those of some metals. They are furthermore resistant to bending and blows as well as being alkali- and acid-constant and are resistant to continuous thermic stress by heated electrolytes. The single substantial disadvantage of the threads, and thus of the synthetic texture (the extruded mesh) lies exclusively in the very low mechanical friction-resistance of its surface area.

In the course of rotation, there takes place a continuous displacement between the accumulation of mass elements and the drum cover. The relative movement which thereby develops can cause extensive wear. The life of the synthetic texture is tremendously reduced especially in case of mass elements with sharp edges or in case of mass elements which have pointed corners.

According to the instant invention, the above-described disadvantage is removed in that the surface area of the drum cover which comes into contact with the charge is being covered with one or a multitude of strips which run parallel to the drum axis. The relative movement between the charge and the textured cover (i.e., a sliding of the mass elements on the wall in rotational direction) is thereby prevented and a rubbing wear is entirely prevented. The form of the strips which extend into the inside of the drum is such that it is able to lock-in the charge mass and is able to carry same along in a slipage-free manner during the course of the rotational movement.

The increased rotation frequency of the charge leads also to a substantial increase of the mixing effect and thus to an even electroplating of all mass elements.

The cylinder bottom is irremovably connected with the cylindrical drum cover. A preferred embodiment of the instant invention proposes to arrange a handle outside the drum and parallel to the symmetric axis of the same.

By means of this handle, the connecting and disconnecting to the basic apparatus becomes simple, fast and secure. The form of the handle corresponds with that of a hook. The drum which is provided with such a hook is also utilized as a basket, preferably for the initial and post-treatment of the charge to be plated in the various solutions. The moving of the light-weight charge through the solutions of the initial and post-treatment (for example during the removal of grease, and rinsing etc.) in the drum which is separated from the apparatus, expedites and eases the practical performance of the entire treatment process. The apparatus represents weight-wise and space-wise a multiple of the drum as it removes additional amounts of solutions.

It is furthermore proposed that the hook-shaped handle is connected with the drum member and mutually with the same can be manufactured in a single phase in the die-casting process.

The instant invention also proposes to arrange two diametrical opposing slits in the area of the circular drum opening (for the loading and unloading of the charge), for the purpose of eventual insertion of a carrying-strap which is independent and running transversely over the drum openings. The slits are located outside the drum cylinder, The carrying-strap can only then be attached when the drum is separated from the apparatus. The drum, in this case, for example can be utilized as a pickling basket or for other purposes. The incorporation of the strap-slits can be made simultaneously during the course of the described manufacture of the drum in the die-casting method.

The drum which is coupled to the apparatus rotates about its symmetric axis. The coupling portion on the apparatus transmits the rotational momentum to the drum and, preferably, has the form of a flat disk, which rotates about an axle-stump. The apparatus stands vertical in the electrolyte and the electric motor which is used for the drive is arranged on the upper portion of the motor which portion is outside the liquid. The drive shaft extending from the motor, also runs in the vertical direction and terminates below the electrolyte level with a drive-in pinion which transmits the rotational momentum by means of direct contact to the coupling disk which is located on the apparatus.

It has been known in the prior art to permit the drum to rotate by means of a gear system consisting of straight-cone gear wheels or by means of a cone belt. Such gear systems are extensive and in case of the belt drives they are also unreliable. The treatment solutions (electrolyte) have varying temperatures and the thermic change (in an interval of 15° C. up to a possible 85° C.) substantially affects the operational safety to the belt drive which depends on the initial stress and the slip.

The instant invention proposes therefore to accomplish the transmission of the rotational momentum by means of a friction wheel gear. The drive pin is surrounded by an O-ring (with a cross sectional diameter in the full material of about 8 mm) which is pressed against a V-shaped and milled groove, which groove is incorporated into the circumference of the coupling disk arranged on the apparatus. The manufacture of friction wheels and their operation is simple. The O-ring can easily be exchanged as an inexpensive wear-part at any time.

BRIEF DESCRIPTION OF THE DRAWINGS

The instant invention is explained in more detail by means of the drawings, wherein:

FIG. 2*a* shows the same lateral view as that seen in FIG. 1*a*, with the two drums of the instant invention being connected;

FIGS. 2*b*, 2*c* and 2*d* are lateral views of the lower portion of the apparatus submerged in the electrolyte, with the varying inventive drums of varying lengths $l_1$ and varying diameters $d_1$ being selectively connected to the apparatus;

FIG. 4*a* is a partial cross-sectional view of the inventive drum and a lower portion of the apparatus to which the drum is connected;

FIG. 4*b* is a longitudinal cross-sectional view of the drum in a phase at right angles to the plane of FIG. 4*a;*

FIG. 5 contains a representation of the sealing means in its three views.

Figures 1A, 1B:
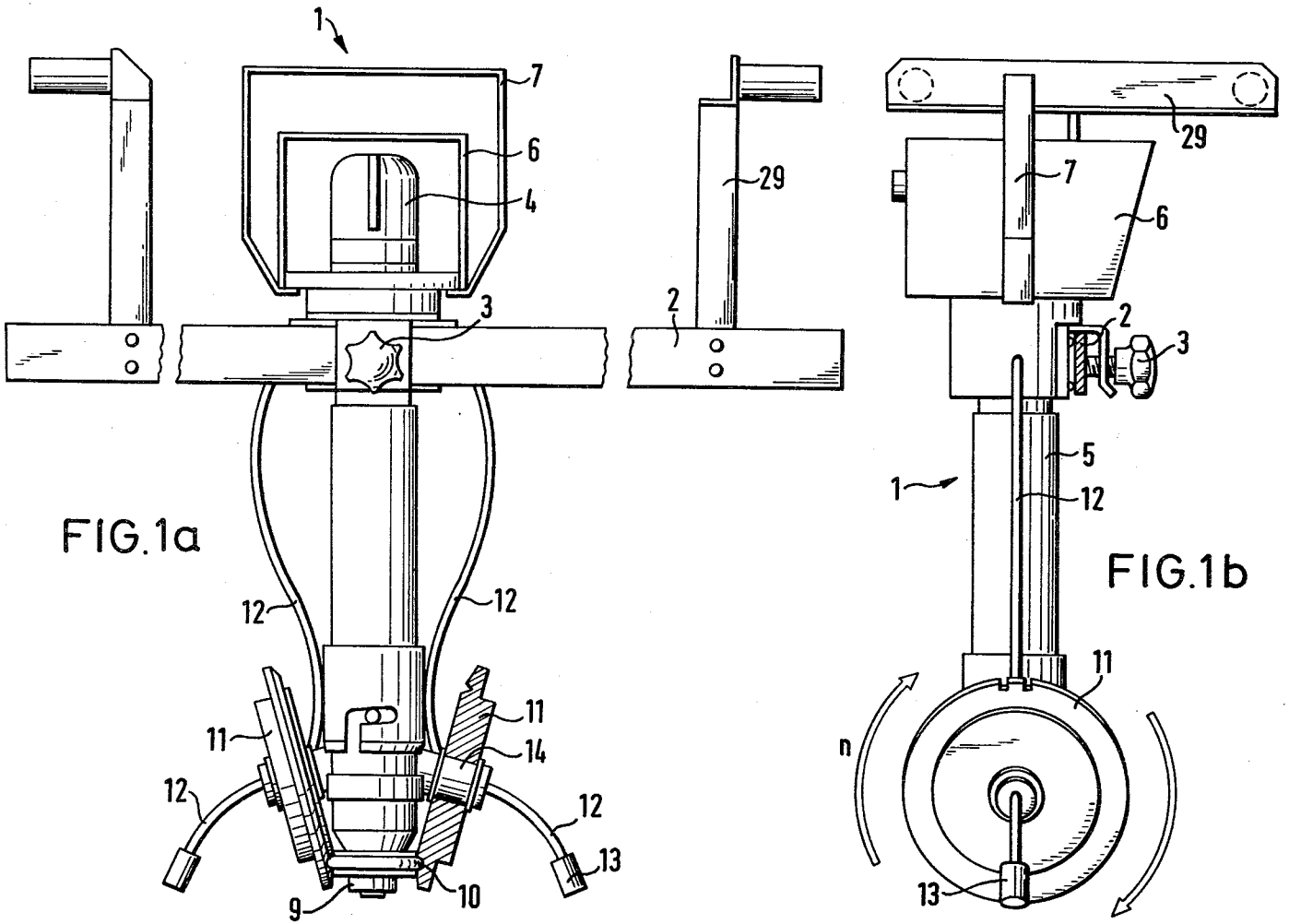
FIGS. 1*a* and 1*b* are lateral views of the apparatus with the drums removed.

As a total element, the apparatus is denoted by numeral 1. The embodiment shows the fastening of the apparatus to the cathode rods 2 by means of the clamping screw 3 which is provided with a star-handle. The construction arranges the motor 4 (preferably a continuous-current motor) at the upper end portion and the gear system for the rotation of the drum is arranged at the lower end portion of the apparatus 1. The constructive complex of the motor 4 and the gear system are connected by means of the vertical tube-shaped shaft housing 5.

The cover 6 protects the motor 4 against being sprayed by the liquid. The handle means 7 enables the manual transport of the drum-apparatus from treating solution to treating solution, or from one working station to another.

The drive shaft 8 (more clearly seen in FIG. 4*a*) extends through the shaft-housing 5 and is engaged with the shaft of the motor 4. The pinion gear 9 is fastened by means of a penetrating bolt at the lower end portion of the drum shaft and has attached to it the O-ring 10 made out of an elastic material.

At both sides of the shaft housing 5 is arranged one drum each. The cover of its axial opening (for loading or unloading with the charges of mass elements) is formed by the disk-shaped coupling portion 11 which is arranged on the apparatus 1.

Pinion gear 9 and coupling disk 11 form a pair of associated friction wheels. These transmit the rotational movement to the coupling portion 11, wherein the elastic O-ring 10 is pressed into a milled V-shaped groove in the coupling disk 11. The hollow axle 14 forms the bearing for the disk 11 and is fastened to the shaft housing 5.

The directional arrows seen in FIG. 1*b* indicate the rotational movement of the coupling portion 11. Its rotational speed n is variable and, depending on the operational stress of the motor, it may be selected by choice in the range of from 2 to 10 rotations per minute and will fulfill most requirements for the electroplating process.

The conduction of the electroplating current into the drums is made by means of cables 12, which terminate with the contact bulbs 13. The cable 12 is guided through the hollow axle 14 into the inside area of the drum.

The assembly 1 is placed onto the cathode rod 2 and obtains from the same (by means of plug-contacts) the electroplating current which is guided via the cables. The cathodic contacting of the mass elements which rotate in the drum can be made in the form of the aforementioned bulb 13 as well as by means of other cathodic contact elements which are known to those of ordinary skill in the art.

The inventive assembly accomodates the various functions of the drum apparatus, namely:

(a) the holding of the drum member in its predetermined operational position in the electrolyte;
(b) the rotating of the drum;
(c) according to requirements, selectively determined rotations; and
(d) the conduction of the electroplating current to the inside area of the drum as well as the cathodic contacting of the mass elements contained therein.

The inventive drum utilized in the assembly, however, fulfills the electroplating requirements which change from each individual application to another, namely, the variable functional sizes;

(e) Drums of various volumes, consequently various lengths and various diameters, as well as
(f) various sizes of perforations.

According to the instant invention, it is possible to thus select all various drums which are required for the various electroplating processes and to change these selectively as needed on the assembly by means of a simple connection and disconnection. The user requires of this invention no longer a multitude of drum-assembly combinations in order to comply with the different requirements of electroplating, but rather requires a single assembly as a basic instrument and a set of differing drums which can selectively be connected and disconnected to the apparatus.

The multiplicity of the connectable drums is seen in FIGS. 2*a*, 2*b*, 2*c* and 2*d*. The basic assembly 1 remains always the same; the set of drums 15 interconnectable with the basic assembly 1, have varying lengths $l_1$, $l_2$, $l_3$ and $l_4$ as well as the varying diameters $d_1$ and $d_2$. The drums 15 may also be provided with varying perforations.

Figure 2C:
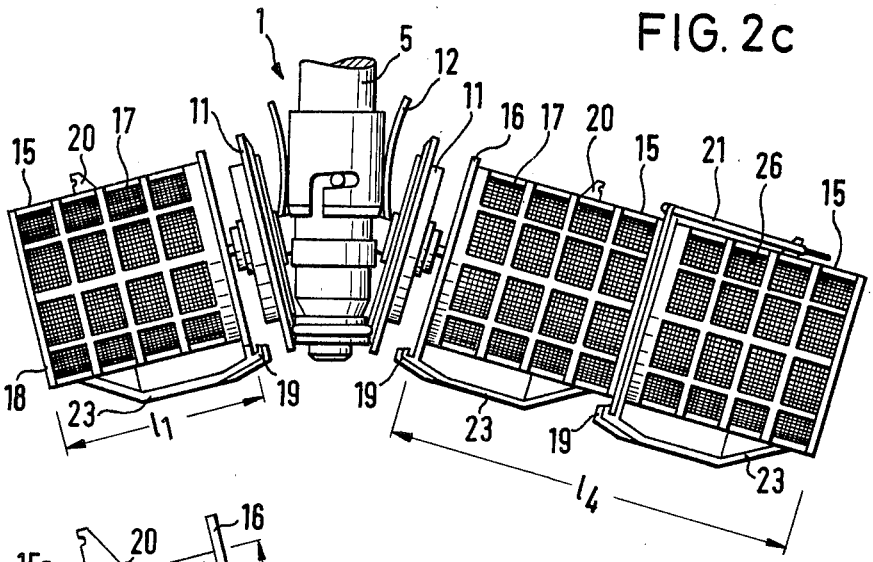
Figure 2D:
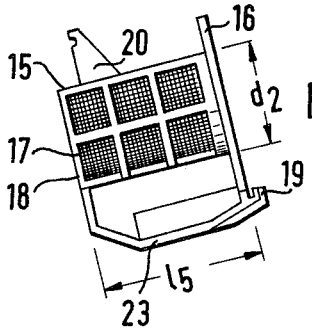

The apparatus according to the embodiment of FIG. 2*a* is provided with two drums 15 of equal lengths $l_1$. The filling volume of the inventive apparatus corresponds with the filling volume of a conventional apparatus which requires a drum of always the same diameter $d_1$, and the length to be also the same, of 2 $l_1$. The arrangement of one each drum 15 at both sides of the apparatus 1 doubles also the electroplating potential of the apparatus of the instant invention compared to the one of the prior art. The simultaneous presence of two, in themselves sealed, drums 15 enables simultaneously the electroplating of two various types of charges of varying mass elements, without having to mix the same. One charge may simultaneously be very large and the second may simultaneously be very small (according to the illustration shown in FIG. 2*b* or FIG. 2*c*).

Figure 3:
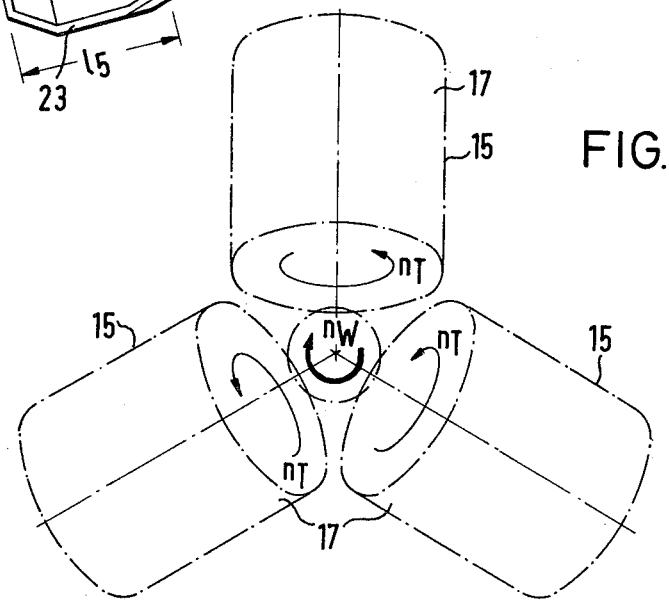
FIG. 3 shows in a basic crosscut the principal star-arrangement of three drums around the apparatus as a center.

FIGS. 2*c* and 3 show examples of further embodiments of the instant invention, with even three varying charges having varying dimensions and varying mass elements to be usable for simultaneous electroplating. The large black arrow in FIG. 3 represents the rotational direction $n_w$ of the central drive shaft 8. The arrows arranged with the drums 15 show their rotational direction $n_T$. The work-time saved by means of these multiple drums with regard to costs in the electroplating industry are very obvious.

The individual drums 15 are coupled to the assembly by means of a coupling element. The disk-shaped coupling portion 11 of the embodiment is located on assembly 1 and the associated disk 16 is located on the drum 15. FIG. 4*a* shows the mechanism of the connecting and disconnecting of the drum 15 on the apparatus.

The coupling portion 11 forms simultaneously a front portion as well as the cover lid for sealing the opening of the drum 15 which is utilized for loading and unloading. The outer diameters of both disk-shaped coupling portion 11 and disk 16 are almost identical. The annular disk 16 is arranged concentrically and outside of the drum cylinder 17 at the loading opening of the drum. The annular disk 16 additionally stiffens the edge of the drum cylinder 17 at the open end of the drum. The other end portion of the drum cylinder 17 is sealed by means of the cylinder bottom of the front portion 18 of the drum, said cylinder bottom being irremovably connected with said drum cylinder. The disk 16 is provided with an adaptedly formed nose portion 19 which, when in connected condition, engages via the peripheral circumference of the coupling portion 11. Diametrically opposite the nose 19 is located a rod 20 which is placed onto the drum cylinder 17.

FIG. 2*a* shows the drum 15 in a connected position, FIG. 4*a* shows the drum in a disconnected position. When the drum 15 is being pushed onto the coupling disk 11, by permitting simultaneously the nose 19 to snap into position over the circumference of the disk, then consequently a rubber-elastic sealing means 21 is spanned between one cavity, milled on the circumference of the coupling portion 11, and the other cavity which is located on the rod 20. The cavity on the coupling disk 11 is illustrated in FIG. 1*b*. The sealing means 21 is illustrated in FIG. 5; the dotted line representing the sealing means 21 in FIG. 4*a* illustrates its operational position with regard to drum 15. The developing force will pull the rod 20 towards the coupling portion 11, and will retain the drum in this position on the assembly.

The above-described sealing mechanism guarantees the suitable mounting of the drum 15 on the assembly 1. For disconnecting the drum 15 it will suffice to pull the fishplate 22 on the sealing means 21 in axial direction, and to remove the drum 15 from the coupling disk 11.

According to the instant invention, the disk 16 of each drum is formed uniformly, i.e., according to a predetermined norm. These measures will guarantee that each drum 15, independent of its length $l_i$, its diameter $d_i$ or cross-section, can be connected to the coupling portion 11 of the assembly 1. A special example therefor is the drum 15 of FIG. 2*d*. Even though its diameter $d_2$ is substantially smaller than the diameter $d_1$ of all other drums 15 (according to FIGS. 2*a*, 2*b* or 2*c*), it can, due to its similar disk 16, also be connected to the assembly 1.

In order to facilitate the connecting and disconnecting of the drum 15 to the assembly 1 in a simple and speedy manner, the drum 15 is provided with a handle 23 in the shape of a hook. The drum 15, which is provided with such a handle 23, can also be utilized as a basket, predominantly for the initial and post-treatment of the charge to be electroplated in the various solutions.

Figure 4C:
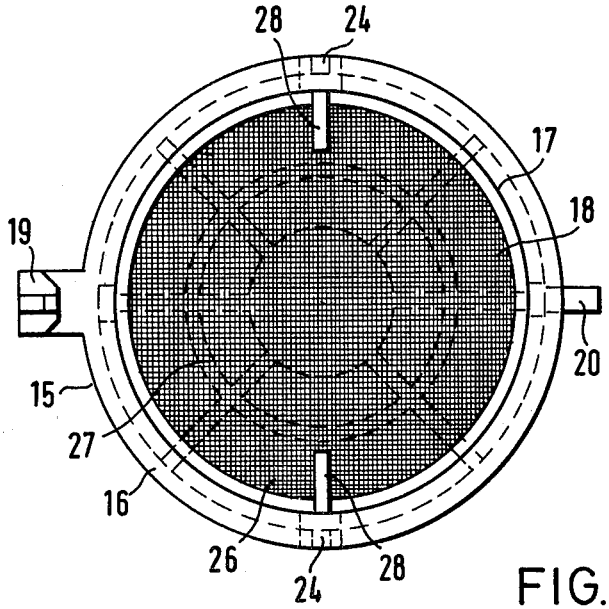
FIG. 4*c* is an end view of the drum of FIG. 4*b;*.

The instant invention also proposes to insert in the area of the drum opening (for providing the charge) two diametrically oppositely positioned holes 24, in order to permit the insertion of carrying handles 25 which run transverse over the drum opening and are independent of the drum 15. The carrying handle 25, removable at any time, can only then be attached when the drum 15 is removed from the apparatus 1. This embodiment of the instant invention is shown in FIGS. 4*a*, 4*b* and 4*c*. The drum 15 can in this case be utilized as, for example, a pickling basket, or for the purposes of treating the mass elements, which do not necessarily require the use of assembly 1 (for example: metallization of synthetic material without current).

The front side 18 which is irremovably connected with the drum cylinder 17, according to the instant invention, is always perforated.

The rotational axis of the drum 15 is horizontal or nearly horizontal. The axis which is tilted by less than 30° and which deviates from the horizontal, appears only when the front side 11 is not perforated. The light tilting of the drum 15 towards the perforated front side 18 causes a partial displacement of the charge (its entire center of gravity) into this direction, i.e., towards said area of the drum member which is mostly perforated.

A preferred embodiment of the instant invention proposes that the wall of the drum cylinder 17 and the front side 18 consist of a texture of synthetic threads or of a fine-net extruded mesh 26. The raw material for this is generally a polypropylene. The very high densities of extremely small mesh-openings ("perforations") represent nearly open wall areas for the penetration of the electroplating flow of the electrolyte. The mesh-widths may be vary small (for example 0.18 mm).

The synthetic mesh 26 is stretched onto a frame 27 and forms together with the frame the inventive drum 15. The manufacture of the drum 15 is made in the die-casting method, i.e., that the frame 27 for the drum cylinder 17 as well as for the front side 18 is produced in a single working process of the die-casting method, whereby the synthetic mesh 26 is inlaid into the casting form. The mesh 26 is cast into the individual rods of the frame 27 or is glued to the same. The material being utilized is also polypropylene.

In order to eliminate extensively the mechanical drag of the thin mesh 26 by means of the charge of mass elements which glide or roll during the rotation on the drum cover 17, the instant invention proposes the arranging of one or a multitude of trip bars 28 which run parallel to the drum axis within the cover 17.

The manufacture of the drum 15 in the die-casting method includes simultaneously the manufacture of the annular coupling disk 16, the nose 19, the rod 20, the handle 23, the holes 24 and the trip bars 28 in one single operation of the die-casting process.

A preferred embodiment of the instant invention proposes that one drum 15 be arranged at each side of the assembly 1. If there would be a case where one would require only one of the two drums 15 for electroplating, then one would connect only one drum 15 to the assembly 1 and disconnect the upper end portion of the cable 12 from the plug-in contact (at the side of the assembly 1 where no drum 15 has been connected). The current of the electroplating flow to the unrequired contact bulb 13 is thereby interrupted. The inventive apparatus can now be utilized only with one drum 15 for the electroplating.

The cables 12 are connected at their upper ends by means of a screw connection, according to the state of the art. Such connections corrode due to the influence of rising vapors from the various treating solutions and the condensation resulting therefrom. It is known in the art that for this reason the screw connections on an electroplating apparatus are hard to release after even a short time.

The instant invention, however, proposes the replacement of the screw connection for the upper end of the cable 12 by means of a plug-in connection. The end of the cable can thus be removed speedily when so required, and namely without any tool, from the plug-in contact, or can be inserted as easily as pushing into the contact.

From FIG. 2*a* there can be seen a double-arrow below the cathode-rod 2. This arrow indicates the alternating periodic movement of the cathode rod 2 in the two directions of its longitudinal axis. It is known in the art to move the objects in the electrolyte, which are to be electroplated and which are fastened on the cathode rod 2, in order to obtain on the objects' surface area, by means of increased electrolyte exchange, a qualitatively improved plating within a short time.

The inventive drum apparatus is fastened to the cathode rod 2 and the same, in the sense of the double-arrow, is set simultaneously into the prior art alternating motion.

The perforated fron portion 18 and especially the utilization of the mesh 26 for the covering as well as the drum cylinder 17 and the front portion 18 will aid in the utilization of the above-described movement process for the first time also for drums and thus also the utilization of all method-technical advantages, in an advantageous electrolyte exchange, which advantages result therefrom.

The FIGS. 1*a* and 1*b* show furthermore that the inventive apparatus is suitable also for utilization in so-called automatic electroplating processes. The assembly 1 is fastened to the cathode rod 2 of a carrier means 29, whereby the carrier means 29 is automatically transported through the entire mechanical installation by means of a conveyor mechanism which is programmed according to path and time element, in order to perform all steps of treatment, which are required.

The disk 16 permits the selective coupling of the drums 15 having any size diameter $d_i$ as well as length $l_i$ or perforation. The same holds true also for the various types of the cathodic contacting of the charges in the drums 15.

Under the term of the inventive drum 15 should also be understood perforated containers for receiving the charges from mass elements which may also have the form of a bell or a basket. The perforated cover (cylinder) 17 of the connectable drums is thus understood not only to be of a circular cylindrical but also a conical, prismatic or of any other desired form.

What is claimed is:

1. A device to facilitate electroplating of a plurality of small elements by moving said elements in an electroplating solution while at the same time passing an electroplating current into said solution, said apparatus comprising:

at least one cylindrical drum means for containing and supporting said elements in said solution, said drum means including a cylindrical portion having two ends and one end portion fixed across one end of said cylinder, at least one of said portions permitting said solution to flow therethrough;

cover means for removably covering said other end of said cylindrical portion forming a closed container through which said solution may pass;

connecting means removably connecting said other end to said cover means;

rotation means, connected to said cover means, for rotating said cover means and said drum means in said solution about an axis of rotation; and current means for supplying an electroplating current through said cover means and into said drum means.

2. The device of claim 1 wherein said axis of rotation forms an angle with the horizontal of less than 30°.

3. The device of claim 2 wherein a plurality of drum means are provided, each drum means having a common-sized disk portion on said other end for interchangeably connecting with said cover means.

4. The device of claim 3 wherein two of said cover means are associated with a single rotation means permitting simultaneous rotation of two drum means connected to said two cover means.

5. The device of claim 3 wherein three cover means are associated with a single rotation means permitting simultaneous rotation of three drum means connected to said three cover means.

6. The device of claim 1 wherein both portions have perforations permitting said solution to flow therethrough.

7. The device of claim 1 wherein said cover means includes perforations permitting said solution to flow therethrough.

8. The device of claim 1 wherein said at least one portion is comprised of a synthetic mesh.

9. The device of claim 1 wherein said drum means includes trip means along the inside of said cylinder for causing said elements to move once said drum is rotated.

10. The device of claim 1 wherein said drum means includes a handle means externally of and connected to said cylindrical portion, said handle means oriented parallel to said axis of rotation.

11. The device of claim 1 wherein there is included a carrying handle and said other end of said cylindrical portion includes means removably connecting said carrying handle to said drum means.

12. The device of claim 1 wherein said rotation means includes electric motor means, and friction drive means, driven by said electric motor means, for driving said cover means.

13. The device of claim 1 wherein said current means includes cable means for conducting said electroplating current into said solution, said cable means including a plug-in contact means for electrically connecting said cable means to a source of electrical current.

* * * * *